US011532254B2

(12) United States Patent
Kim et al.

(10) Patent No.: US 11,532,254 B2
(45) Date of Patent: Dec. 20, 2022

(54) APPARATUS FOR DRIVING STRETCHABLE DISPLAY

(71) Applicant: UIF (University Industry Foundation), Yonsei University, Seoul (KR)

(72) Inventors: Hyun Jae Kim, Seoul (KR); Dongwoo Kim, Seoul (KR); Won Kyung Min, Seoul (KR); Jusung Chung, Seoul (KR); Jin Hyeok Lee, Seoul (KR); Dong Hyun Choi, Seoul (KR); Min Seong Kim, Seoul (KR); Gwan In Kim, Seoul (KR)

(73) Assignee: UIF (University Industry Foundation), Yonsei University, Seoul (KR)

( * ) Notice: Subject to any disclaimer, the term of this patent is extended or adjusted under 35 U.S.C. 154(b) by 0 days.

(21) Appl. No.: 17/570,355

(22) Filed: Jan. 6, 2022

(65) Prior Publication Data

US 2022/0223079 A1 Jul. 14, 2022

(30) Foreign Application Priority Data

Jan. 12, 2021 (KR) ..... 10-2021-0004133

(51) Int. Cl.
*G09G 3/00* (2006.01)

(52) U.S. Cl.
CPC ..... *G09G 3/035* (2020.08); *G09G 2300/0809* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 4,812,681 | A | 3/1989 | Pumphrey | |
| 7,116,318 | B2 | 10/2006 | Amundson et al. | |
| 7,605,799 | B2 | 10/2009 | Amundson et al. | |
| 10,186,180 | B2 * | 1/2019 | Park | G09G 3/006 |
| 2015/0379926 | A1 | 12/2015 | Wu et al. | |
| 2016/0126241 | A1 | 5/2016 | Ellinger | |

(Continued)

FOREIGN PATENT DOCUMENTS

| | | | |
|---|---|---|---|
| JP | S59-047844 | A | 3/1984 |
| JP | 2019-191469 | A | 10/2019 |

(Continued)

*Primary Examiner* — Matthew Yeung
(74) *Attorney, Agent, or Firm* — Park, Kim & Suh, LLC

(57) ABSTRACT

An apparatus for driving a stretchable display includes a first pixel driving signal generating module to generate a first pixel driving signal including data to be displayed on a stretchable display, a first pixel driving circuit to receive the first pixel driving signal to drive a first pixel, a second pixel driving circuit to drive a second pixel, wherein the driving of the second pixel is determined depending on whether the stretchable display is stretched, and a second pixel driving signal generating module to receive the first pixel driving signal and a power signal and to generate a second pixel driving signal to be applied to the second pixel driving circuit by using one of the first pixel driving signal and the power signal, based on a stretching state signal generated depending on whether the stretchable display is stretched.

15 Claims, 5 Drawing Sheets

(56) References Cited

U.S. PATENT DOCUMENTS

| | | | | |
|---|---|---|---|---|
| 2018/0261163 | A1* | 9/2018 | Hyun | G09G 3/003 |
| 2018/0342192 | A1* | 11/2018 | Lee | G09G 3/2007 |
| 2020/0143729 | A1* | 5/2020 | Xu | G09G 3/2007 |
| 2020/0388228 | A1* | 12/2020 | Oh | G09G 5/373 |
| 2021/0407424 | A1* | 12/2021 | Long | G09G 3/2022 |

FOREIGN PATENT DOCUMENTS

| | | | |
|---|---|---|---|
| KR | 10-2000-0038147 | A | 7/2000 |
| KR | 10-2016-0047064 | A | 5/2016 |
| KR | 10-2016-0053358 | A | 5/2016 |
| KR | 10-2016-0084964 | A | 7/2016 |
| KR | 10-2016-0091121 | A | 8/2016 |
| KR | 10-2017-0100719 | A | 9/2017 |
| KR | 10-2017-0109179 | A | 9/2017 |
| KR | 10-2019-0139598 | A | 12/2019 |
| KR | 10-2019-0139600 | A | 12/2019 |
| KR | 10-2020-0029042 | A | 3/2020 |

* cited by examiner

APPARATUS FOR DRIVING STRETCHABLE DISPLAY

CROSS-REFERENCE TO RELATED APPLICATIONS

A claim for priority under 35 U.S.C. § 119 is made to Korean Patent Application No. 10-2021-0004133 filed on Jan. 12, 2021, in the Korean Intellectual Property Office, the entire contents of which are hereby incorporated by reference.

BACKGROUND

Embodiments of the inventive concept described herein relate to an apparatus for driving a stretchable display.

Recently, studies and researches have been performed on flexible display devices which are folded or rolled in a roll type, as a technology related to a display is advanced. Furthermore, studies and researches have been actively performed on a stretchable display device which is changeable in various forms. Meanwhile, in the stretchable display device, the resolution may be reduced due to an increase in the spacing between pixels, when the display device is stretched.

The inventive concept is derived from studies and researches conducted as part of the Ministry of Science and ICT's development of a nano-future material source technology (Project No.: 171111995; Task No.: 2020M3H4A1A02084896; Research Subject Name: 2-axis Flexible and Sensitive AMLED Display Backplane Material/Device Technology; Task Management Agency: National Research Foundation of Korea; and Research Period: Jul. 1, 2020 to Dec. 31, 2020).

Meanwhile, the Korean government, which is the subject of providing tasks in all aspects of the invention, does not have property benefits for the invention.

SUMMARY

Embodiments of the inventive concept provide an apparatus for driving a stretchable display, capable of maintaining the resolution of a display before and after the display is stretched. The apparatus for driving the stretchable display may generate a second pixel driving signal for driving a second pixel additionally provided, based on whether the stretchable display device is stretched, a first pixel driving signal applied to a first pixel driving circuit, and a power signal.

Meanwhile, the technical objects obtained in the inventive concept are not limited to the aforementioned effects, and any other technical objects not mentioned herein will be clearly understood from the following description by those skilled in the art to which the inventive concept pertains.

According to an exemplary embodiment of the inventive concept, an apparatus for driving a stretchable display includes a first pixel driving signal generating module to generate a first pixel driving signal including data to be displayed on a stretchable display, a first pixel driving circuit to receive the first pixel driving signal to drive the first pixel, a second pixel driving circuit to drive a second pixel in which the driving of the second pixel is determined depending on whether the stretchable display is stretched, and a second pixel driving signal generating module to receive the first pixel driving signal and a power signal and to generate a second pixel driving signal to be applied to the second pixel driving circuit by using any one of the first pixel driving signal and the power signal, based on a stretching state signal generated depending on whether the stretchable display is stretched.

The apparatus for driving the stretchable display includes a second pixel driving signal generating module to receive the first pixel driving signal and a power signal and to generate a second pixel driving signal to be applied to the second pixel driving circuit by using any one of the first pixel driving signal and the power signal, based on a stretching state signal generated depending on whether the stretchable display is stretched.

The second pixel driving signal generating module may include a second pixel driving signal generating unit to generate a second pixel driving signal, based on whether the stretchable display is stretched, a first pixel driving signal applied to the first pixel driving circuit, and the power signal, such that the second pixel driving signal is applied to the second pixel driving circuit including a second pixel.

The second pixel driving signal generating module may include a first pixel driving signal receiver to receive the first pixel driving signal generated from the first pixel driving signal generating unit and applied to the first pixel driving circuit, a power signal receiver to receive a power signal, and a stretching state signal generating unit to generate a stretching state signal depending on whether the stretchable display is stretched.

The stretching state signal generating unit may generate a first stretching state signal, when the stretchable display is stretched, and may generate a second stretching state signal, when the stretchable display is not stretched.

The second pixel driving signal generating unit may generate the second pixel driving signal based on the first pixel driving signal, when receiving a first stretching state signal, and may generate the second pixel driving signal based on the power signal, when receiving a second stretching state signal.

The second pixel driving signal generating unit may include a first transistor and a second transistor.

The first transistor may include a P-channel metal-oxide-semiconductor field-effect transistor (PMOSFET; hereinafter, briefly referred to as a "PMOS transistor"), and the second transistor may include an N-channel metal-oxide-semiconductor field-effect transistor (NMOSFET; hereinafter, briefly referred to as an "NMOS transistor").

A source terminal of the first transistor may be connected to the first pixel driving signal receiver, a source terminal of the second transistor may be connected to the power signal receiver, gate terminals of the first transistor and the second transistor may be connected to the stretching state signal generating unit, and a drain terminal of the first transistor and a drain terminal of the second transistor may be connected to each other.

The first stretching state signal may be a preset fourth voltage, the second stretching state signal may be a preset third voltage, and the power signal may be a preset first voltage.

The first transistor may include a first PMOS transistor, and the second transistor may include a second PMOS transistor.

A source terminal and a gate terminal of the first transistor may be connected to the first pixel driving signal receiver, a drain terminal of the second transistor may be connected to the power signal receiver, the gate terminal of the second transistor may be connected to the stretching state signal generating unit, and a drain terminal of the first transistor and a source terminal of the second transistor may be connected to each other.

The first stretching state signal may be a preset third voltage, the second stretching state signal may be a preset fourth voltage, and the power signal may be a preset second voltage.

The first transistor may include a first NMOS transistor, the second transistor may include a second NMOS transistor.

A drain terminal of the first transistor may be connected to the first pixel driving signal receiver, a source terminal of the second transistor may be connected to the power signal receiver, a gate terminal of the second transistor may be connected to the stretching state signal generating unit, and the source terminal of the first transistor, the gate terminal of the first transistor, and the drain terminal of the second transistor may be connected to each other.

The first stretching state signal may be a preset fourth voltage, the second stretching state signal may be a preset third voltage, and the power signal may be a preset first voltage.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
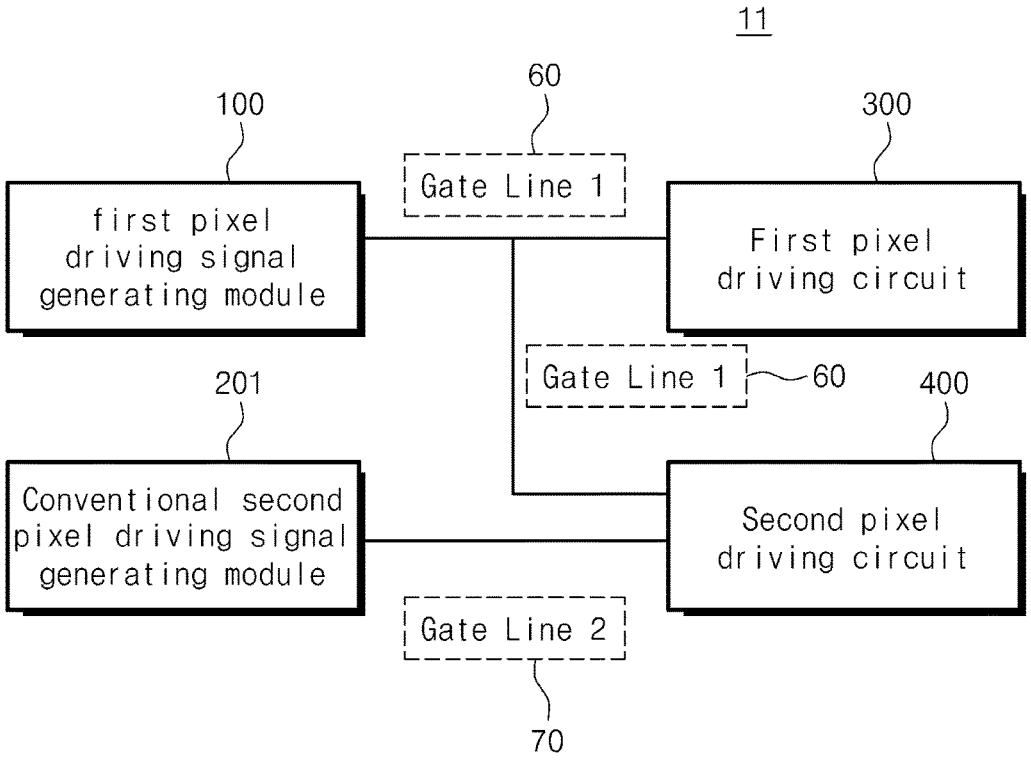
FIG. 1 is a block diagram illustrating a conventional apparatus for driving a stretchable display.

Advantage points and features of the inventive concept and a method of accomplishing thereof will become apparent from the following description with reference to accompanying drawings and embodiments to be described in detail with reference to the accompanying drawings. However, the inventive concept may be embodied in various different forms, and should not be construed as being limited only to the illustrated embodiments. Rather, these embodiments are provided as examples so that this disclosure will be thorough and complete, and will fully convey the concept of the inventive concept to those skilled in the art. The inventive concept may be defined by scope of the claims.

Unless otherwise specified, all terms used herein, including technical or scientific terms, have the same meanings as those generally understood by those skilled in the art to which the inventive concept pertains.

It will be further understood that terms used herein should be interpreted as having a meaning that is consistent with their meaning in the context of this disclosure and the relevant art and will not be interpreted in an idealized or overly formal sense unless expressly so defined in the inventive concept.

The terms used in the inventive concept are provided for the illustrative purpose, but the inventive concept is not limited thereto. As used herein, the singular terms are intended to include the plural forms as well, unless the context clearly indicates otherwise.

Furthermore, it will be further understood that the terms "comprises", and/or various modifications, such as "comprising," "includes" and/or "including", when used herein, specify the presence of stated compositions, ingredients, components, steps, operations, and/or elements, but do not preclude the presence or addition of one or more other compositions, ingredients, components, steps, operations, and/or elements. In the disclosure, the term "and/or" indicates each of associated listed items and include various possible combinations of one or more of the associated listed items.

Meanwhile, the term '~unit', '~or', '~block', or '~module' may refer to the unit of processing at least one function or operation. For example, the term '~unit', '~or', '~block', or '~module' may refer to a hardware component such as a field-programmable gate array (FPGA) or an application-specific integrated circuit (ASIC).

However, the term '~unit', '~or', '~block', or '~module' is not limited to software or hardware. The term '~unit', '~or', '~block', or '~module' may be configured to be present in a storage medium to be assigned with addresses and may be configured to reproduce one or more processors.

Accordingly, for example, the term '~unit', '~or', '~block', or '~module' may include components, such as software components, object-oriented software components, class components, and task components, processes, functions, properties, procedures, subroutines, program code segments, drivers, firmware, microcodes, circuits, data, database, data structures, tables, arrangements or variables.

Components and functions provided in '~unit', '~or', '~block', or '~module' may be combined into the smaller number of components and '~unit', '~or', '~block', or '~module' or may be further split into additional components and '~unit', '~or', '~block', or '~module'.

Hereinafter, an embodiment of the inventive concept will be described in detail with reference to accompanying drawings.

Figure 2:
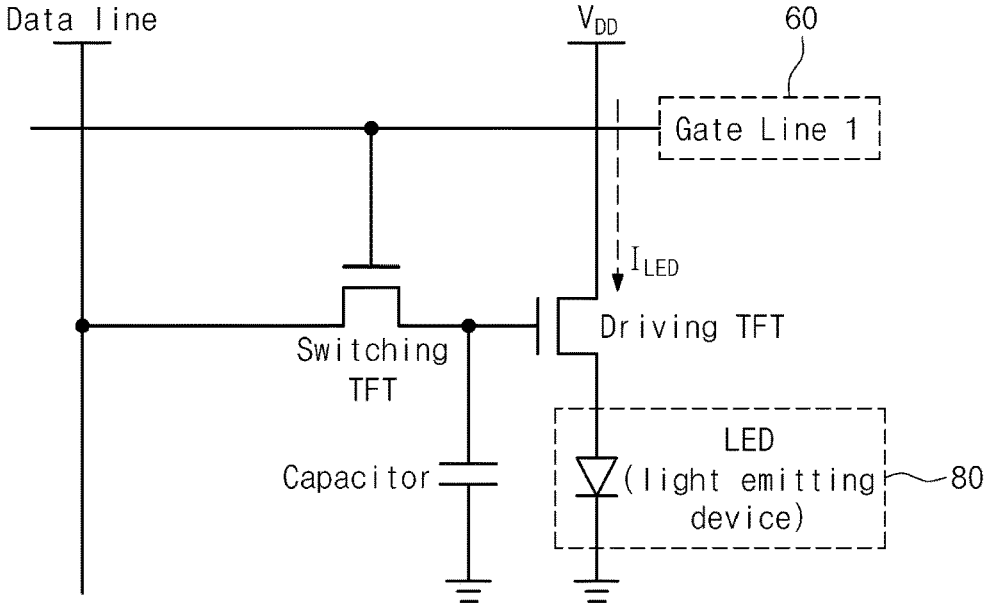
FIG. 2 is a view schematically illustrating a first pixel driving circuit.
Figure 3:
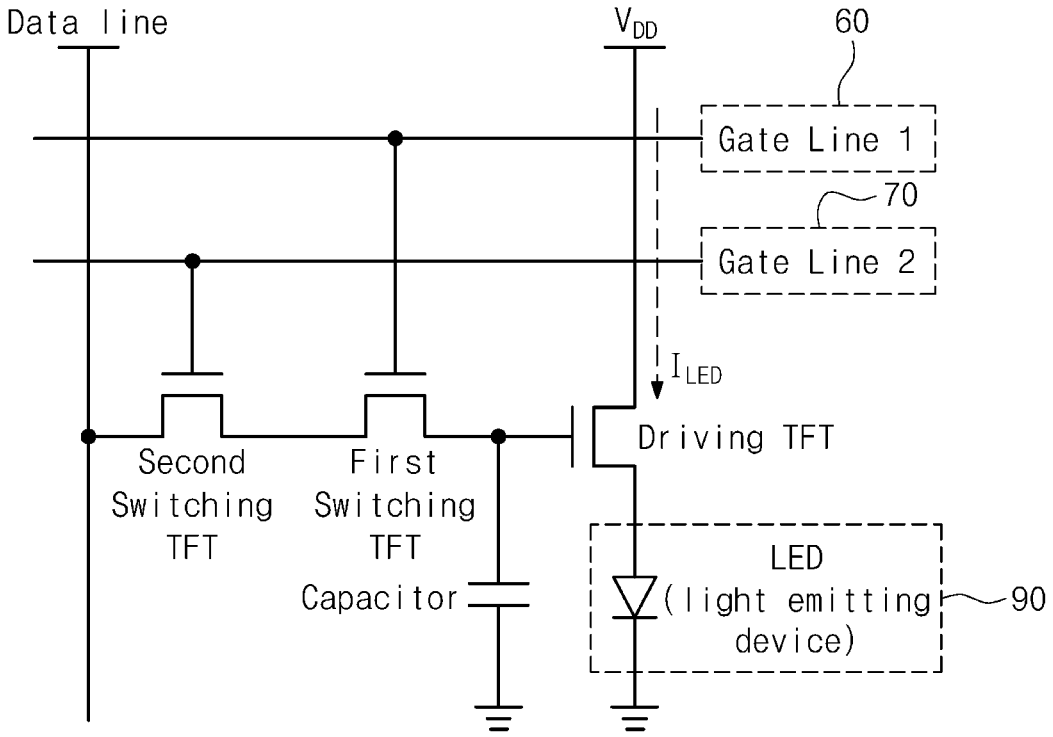
FIG. 3 is a view schematically illustrating a second pixel driving circuit.

FIG. 1 is a block diagram illustrating a conventional apparatus 11 for driving a stretchable display, FIG. 2 is a view schematically illustrating a first pixel driving circuit 300, and FIG. 3 is a view schematically illustrating the second pixel driving circuit 400.

Referring to FIGS. 1 to 3, the conventional apparatus 11 for driving a stretchable display includes a first pixel driving signal generating module 100, a conventional second pixel driving signal generating module 201, a first pixel driving circuit 300, and the second pixel driving circuit 400.

The first pixel driving signal generating module 100 may generate a first pixel driving signal including data to be displayed. The first pixel driving circuit 300 is configured to receive the first pixel driving signal to drive the first pixel 80.

For example, the first pixel driving circuit 300 may drive a first pixel 80, based on the first pixel driving signal, when receiving the first pixel driving signal, regardless of whether the stretchable display is stretched.

In addition, the second pixel driving circuit 400 also refers to a circuit to drive a second pixel 90 in which the driving of the second pixel 90 is determined depending on whether the stretchable display is stretched.

In more detail, the second pixel driving circuit 400 is provided in a space of the first pixel 80 to maintain the resolution after the stretchable display is stretched such that the second pixel 90 is additionally driven.

A first pixel driving signal applied to the first pixel driving circuit 300 through a first gate line 60 is generated from the first pixel driving signal generating module 100, and a second pixel driving signal applied to the second pixel driving circuit 400 through a second gate line 70 may be generated from a conventional second pixel driving signal generating module 201.

For example, only the first pixel 80 is driven through the first pixel driving circuit 300 before the stretchable display is stretched. However, when the driving of an additional display pixel is required, as the stretchable display is stretched, the second pixel driving signal generated from the conventional second pixel driving signal generating module 201 is applied to the second pixel driving circuit 400 such that the second pixel 90 is additionally driven.

Accordingly, to drive the second pixel 90 included in the second pixel driving circuit 400, the conventional second pixel driving signal generating module 201 is additionally required, which causes a problem in which the stretchable display is thickened or a bezel is widened.

Referring back to FIG. 2, the first pixel driving circuit 300 may receive the first pixel driving signal through the first gate line 60 connected to the first pixel driving signal generating module 100 to drive the first pixel 80.

Referring back to FIG. 3, the second pixel driving circuit 400 may receive the first pixel driving signal through the first gate line 60 connected to the first pixel driving signal generating module 100, and may receive the second pixel driving signal through the second gate line 70 connected to the conventional second pixel driving signal generating module 201 to drive the second pixel 90.

The first pixel driving circuit 300 and the second pixel driving circuit 400 illustrated in FIGS. 2 and 3 may be identically applied to the inventive concept.

Figure 4:
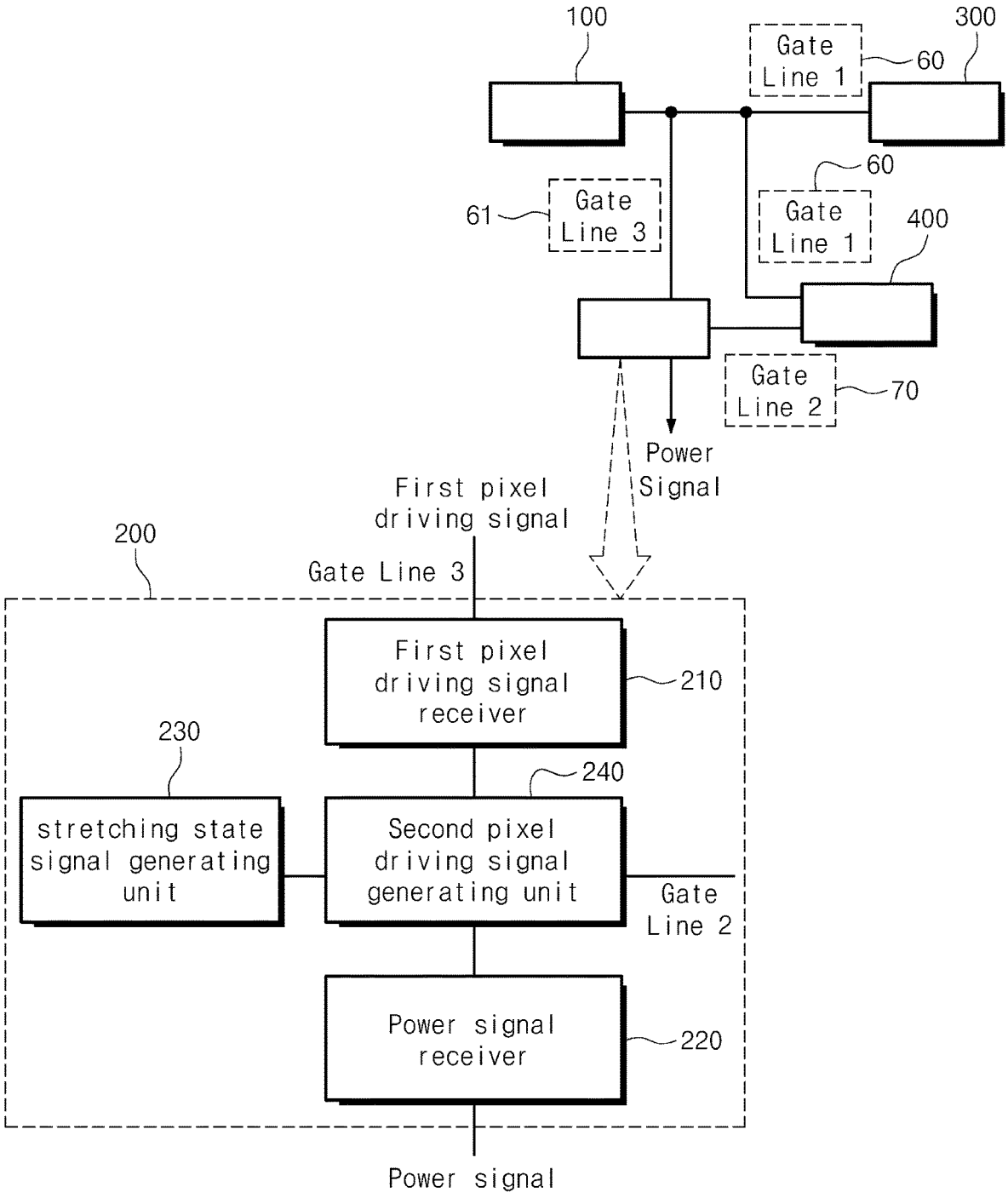
FIG. 4 is a block diagram illustrating a stretchable display including an apparatus for driving the stretchable display, according to an embodiment of the inventive concept.

FIG. 4 is a block diagram illustrating a stretchable display including an apparatus 10 for driving the stretchable display, according to an embodiment of the inventive concept.

Referring to FIG. 4, although an apparatus 10 for driving the stretchable display according to the inventive concept shares a basic structure and a basic operation principle with the conventional apparatus 11 for driving a stretchable display, the apparatus 10 for driving the stretchable display according to the inventive concept is characterized in that the conventional second pixel driving signal generating module 201 is substituted into a second pixel driving signal generating module 200.

The apparatus 10 for driving a stretchable display according to the inventive concept may include the first pixel driving signal generating module 100, the second pixel driving signal generating module 200, the first pixel driving circuit 300, and the second pixel driving circuit 400, and the second pixel driving signal generating module 200 may include a first pixel driving signal receiver 210, a power signal receiver 220, a stretching state signal generating unit 230, and a second pixel driving signal generating unit 240.

The second pixel driving signal generating module 200 may receive the first pixel driving signal and the power signal, and may generate the second pixel driving signal using any one of the first pixel driving signal and the power signal, based on a stretching state signal generated depending on whether the stretchable display is stretched.

The first pixel driving signal receiver 210 is configured to receive the first pixel driving signal which is generated from the first pixel driving signal generating module 100 and applied to the first pixel driving circuit 300 and the first pixel driving circuit 300. To this end, the first pixel driving signal is received through a third gate line 61 which is a new gate line branching from the existing first gate line 60.

The power signal receiver 220 is configured to receive the power signal. The power signal may be a Gate Line Low Voltage (VGL), which is a preset first voltage, or a Gate Line High Voltage (VGH) which is a preset second voltage.

The 'VGL', which is the preset first voltage, may refer to a cathode gate voltage, and may be in the range of, for example, −15 V to −5 V.

The 'VGH', which is the preset second voltage, may refer to an anode gate voltage, and may be in the range of, for example, 10 V to 20 V.

For example, the power signal may be selected as any one of 'VGL' or 'VGH' depending on the components of the second pixel driving signal generating unit 240. The more detailed description thereof will be described together in the following description of the second pixel driving signal generating unit 240 according to first to third embodiments.

The stretching state signal generating unit 230 may be configured to determine whether a stretchable display panel is stretched, and generate various stretching state signals depending on the determination result.

For example, whether the stretchable display panel is stretched may be determined depending whether the spacing between the first pixels 80 exceeds a preset reference value. In addition, whether the stretchable display panel is stretched may be determined without limitation in various well-known manners of determining whether the stretchable display is stretched.

In more detail, the stretching state signal generating unit 230 may be configured to generate a first stretching state signal when the stretchable display is stretched, and to generate a second stretching state signal, when the stretchable display is not stretched.

For example, the first stretching state signal may be selected as having any one of a high level voltage, which is a preset third voltage, or a low level voltage which is a preset fourth voltage, depending on the configurations of the second pixel driving signal generating unit 240. The more detailed description thereof will be described below together with the second pixel driving signal generating unit 240 according to the first to third embodiments.

The second pixel driving signal generating unit 240 is configured to generate the second pixel driving signal, based on different stretching state signals generated by the stretching state signal generating unit 230, the first pixel driving signal received through the first pixel driving signal receiver 210, and the power signal received through the power signal receiver 220 and to apply the second pixel driving signal to the second pixel driving circuit 400 including the second pixel 90.

For example, when receiving the first stretching state signal generated from the stretching state signal generating unit 230, the second pixel driving signal generating unit 240 may generate the second pixel driving signal based on the first pixel driving signal received from the first pixel driving signal receiver 210 and may transmit the second pixel driving signal to the second pixel driving circuit 400 through the second gate line 70.

In addition, when receiving the stretching state signal generated from the stretching state signal generating unit 230, the second pixel driving signal generating unit 240 may generate the second pixel driving signal based on the power signal received from the power signal receiver 220 and may transmit the second pixel driving signal to the second pixel driving circuit 400 through the second gate line 70.

The second pixel driving signal generating unit 240 may include a first transistor 241 and a second transistor 242.

Figure 5:
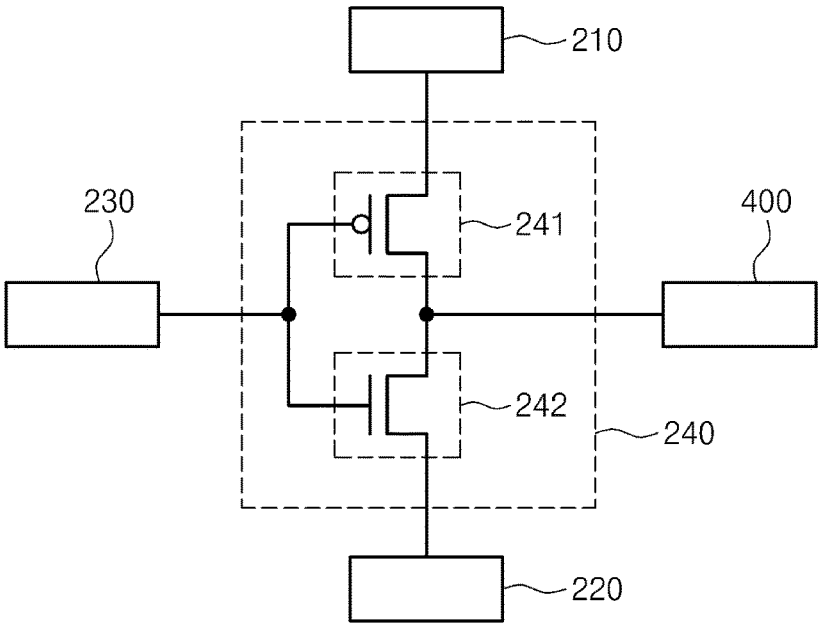
FIG. 5 is a circuit diagram of a second pixel driving signal generating unit, according to a first embodiment of the inventive concept.

FIG. 5 is a circuit diagram of the second pixel driving signal generating unit 240, according to a first embodiment of the inventive concept.

Referring to FIG. 5, in the second pixel driving signal generating unit 240 according to the first embodiment, the first transistor 241 may include a PMOS transistor, and the second transistor 242 may include an NMOS transistor.

Regarding the circuit configuration of the second pixel driving signal generating unit 240 according to the first embodiment, a source terminal of the first transistor 241 is connected to the first pixel driving signal receiver 210, a source terminal of the second transistor 242 is connected to the power signal receiver 220, gate terminals of the first transistor 241 and the second transistor 242 are connected to the stretching state signal generating unit 230, a drain terminal of the first transistor 241 and a drain terminal of the second transistor 242 are connected to each other.

As described above, the stretching state signal generating unit 230 may be configured to generate the first stretching state signal, when the stretchable display is stretched, and to generate the second stretching state signal, when the stretchable display is not stretched.

According to the first embodiment, the first stretching state signal may a low level voltage, and the second stretching state signal may be a high level voltage.

In this case, the low level voltage may be a voltage sufficiently low to form a conductive channel in the first transistor 241 and to remove a conductive channel from the second transistor 242, and the high level voltage may be a voltage sufficiently high to remove the conductive channel from the first transistor 242 and to form the conductive channel in the second transistor 242.

When the first stretching state signal is applied to the second pixel driving signal generating unit 240, the first transistor 241 is short-circuited and the second transistor 242 is open, such that the first pixel driving signal is applied to an output terminal of the second pixel driving signal generating unit 240.

According to the first embodiment, the second pixel driving signal generating unit 240 applies the first pixel driving signal, which serves as the second pixel driving signal, to the second pixel driving circuit 400. Accordingly, the second pixel 90 may be driven.

According to the first embodiment, a power signal may be 'VGL'.

When the second stretching state signal is applied to the second pixel driving signal generating unit 240, the first transistor 241 is open and the second transistor 242 is short-circuited, such that the power signal of 'VGL' is applied to the output terminal of the second pixel driving signal generating unit 240.

In more detail, the power signal of 'VGL', which is the power signal, may be applied to a gate terminal of a second switching thin film transistor (TFT). When the second switching TFT is provided in an NMOS type, the VGL may be a voltage sufficiently low to remove a conductive channel from the second switching TFT.

That is to say, according to the first embodiment, the second pixel driving signal generating unit 240 applies the power signal of 'VGL', which serves as the second pixel driving signal, to the second pixel driving circuit 400. Accordingly, the second pixel 90 may not be driven.

Figure 6:
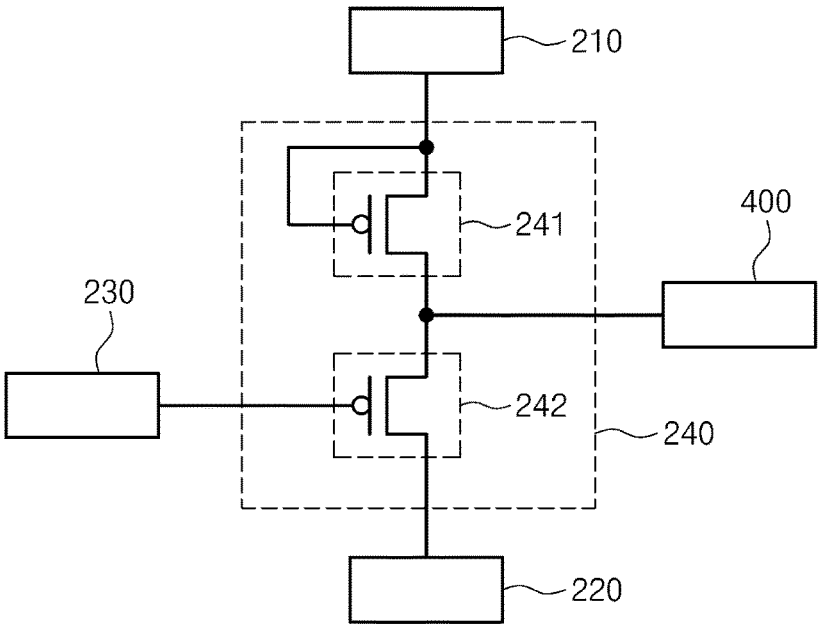
FIG. 6 is a circuit diagram of the second pixel driving signal generating unit, according to a second embodiment of the inventive concept.

FIG. 6 is a circuit diagram of the second pixel driving signal generating unit 240, according to a second embodiment of the inventive concept.

Referring to FIG. 6, in the case of the second pixel driving signal generating unit 240 according to the second embodiment, the first transistor 241 may include a first PMOS transistor, and the second transistor 242 may include a second PMOS transistor.

Regarding the circuit configuration of the second pixel driving signal generating unit 240 according to the second embodiment, the source terminal and the gate terminal of the first transistor 241 are connected to the first pixel driving signal receiver 210, the drain terminal of the second transistor 242 is connected to the power signal receiver 220, the gate terminal of the second transistor 242 is connected to the stretching state signal generating unit 230, the drain terminal of the first transistor 241 and the source terminal of the second transistor 242 are connected to each other.

As described above, the stretching state signal generating unit 230 may be configured to generate the first stretching state signal, when the stretchable display is stretched, and to generate the second stretching state signal, when the stretchable display is not stretched.

According to the second embodiment, the first tensile state signal may be a high level voltage, and the second tensile state signal may be a low level voltage.

In this case, the high level voltage may be a voltage sufficiently low to remove a conductive channel from the second transistor 242, and the low level voltage may be a voltage sufficiently low to form a conductive channel in the second transistor 242. When the first stretching state signal is applied to the second pixel driving signal generating unit 240, the first transistor 241 is short-circuited and the second transistor 242 is open, such that the first pixel driving signal is applied to an output terminal of the second pixel driving signal generating unit 240.

That is to say, according to the second embodiment, the second pixel driving signal generating unit 240 applies the first pixel driving signal, which serves as the second pixel driving signal, to the second pixel driving circuit 400. Accordingly, the second pixel 90 may be driven.

According to the second embodiment, the power signal may be 'VGH'.

When a second tensile state signal is applied to the second pixel driving signal generating unit 240, the first transistor 241 is open and the second transistor 242 is short-circuited, such that the power signal of 'VGH' is applied to the output terminal of the second pixel driving signal generating unit 240.

According to the second embodiment, the second switching TFT included in the second pixel driving circuit 400 may be provided in a PMOS type. In more detail, a power signal of 'VGH' may be applied to the gate terminal of the second switching TFT. When the second switching TFT is provided in the PMOS type, the VGH may be a voltage sufficiently high to remove a conductive channel from the second switching TFT.

That is to say, according to the second embodiment, the second pixel driving signal generating unit 240 applies the second pixel driving signal, which is the power signal of 'VGH', to the second pixel driving circuit 400. Accordingly, the second pixel 90 may NOT be driven.

Figure 7:
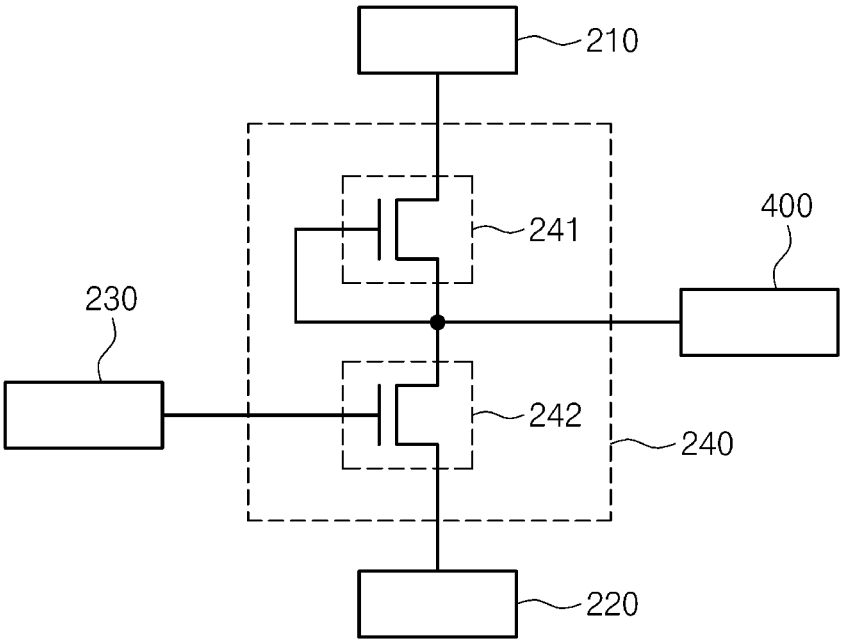
FIG. 7 is a circuit diagram of the second pixel driving signal generating unit, according to a third embodiment of the inventive concept.

FIG. 7 is a circuit diagram of the second pixel driving signal generating unit 240 according to the third embodiment of the inventive concept.

Referring to FIG. 7, in the second pixel driving signal generating unit 240 according to the third embodiment, the first transistor 241 may include a first NMOS transistor, and the second transistor 242 may include a second NMOS transistor. In this case, the first NMOS transistor included in the first transistor 241 may be a depletion-type NMOS transistor.

Regarding the circuit configuration of the second pixel driving signal generating unit 240 according to the third embodiment, the drain terminal of the first transistor 241 is connected to the first pixel driving signal receiver 210, the source terminal of the second transistor 242 is connected to the power signal receiver 220, the gate terminal of the second transistor 242 is connected to the stretching state signal generating unit 230, the source terminal of the first transistor 241, the gate terminal of the first transistor 241, and the drain terminal of the second transistor 242 may be connected to each other.

As described above, when the spacing between the first pixels 80 exceeds the preset reference value, the stretching state signal generating unit 230 generates the first stretching state signal. When the spacing between the first pixels 80 is less than the preset reference value, the stretching state signal generating unit 230 generates the second stretching state signal.

According to the third embodiment, the first stretching state signal may be a low level voltage, and the second stretching state signal may be a high level voltage.

In this case, the low level voltage may be a voltage sufficiently low to remove a conductive channel in the second transistor 242, and the high level voltage may be a voltage sufficiently high to form a conductive channel in the second transistor 242.

When the first stretching state signal is applied to the second pixel driving signal generating unit 240, the second transistor 242 is open. In this case, although a voltage is not applied to the gate terminal of the first transistor 241, the first transistor 241 may include a depletion-type NMOS transistor. Accordingly, the first transistor 241 operates as being shorted-circuit. Accordingly, the first pixel driving signal may be applied to the output terminal of the second pixel driving signal generating unit 240.

That is to say, according to the third embodiment, the second pixel driving signal generating unit 240 applies the first pixel driving signal, which serves as the second pixel driving signal, to the second pixel driving circuit 400. Accordingly, the second pixel 90 may be driven.

According to the third embodiment, the power signal may be 'VGL'.

When the second stretching state signal is applied to the second pixel driving signal generating unit 240, the second transistor 242 is shorted-circuit. Accordingly, the power signal of 'VGL' may be applied to the gate terminal of the transistor 241. When the power signal of 'VGL' is applied to the gate terminal of the first transistor 241, the first transistor 241 is open. Accordingly, the power signal of 'VGL' may be applied to the output terminal of the second pixel driving signal generating unit 240. In more detail, the power signal of 'VGL' may be applied to the gate terminal of the second switching TFT. When the second switching TFT is provided in the NMOS type, the power signal of 'VGL' may be a voltage sufficiently low to remove the conductive channel from the second switching TFT.

That is to say, according to the third embodiment, the second pixel driving signal generating unit 240 applies the power signal of 'VGL', which serves as the second pixel driving signal, to the second pixel driving circuit 400. Accordingly, the second pixel 90 may be driven.

As described in the operation of the second pixel driving signal generating unit 240 according to the first to third embodiments, the first stretching state signal, the second stretching state signal, and the power signal may be varied depending on the configuration of the second pixel driving signal generating unit 240.

In other words, the first stretching state signal, the second stretching state signal, and the power signal may be changed without limitation depending on the configuration of the second pixel driving signal generating unit 240, as long as the first pixel driving signal is applied to the second pixel driving circuit 400, such that the second pixel 90 is driven, when the stretchable display is stretched, and the power signal is applied to the second pixel driving circuit 400, such that the second pixel 90 is not driven, when the stretching state signal is not stretched.

According to an embodiment of the disclosure, the apparatus for driving a stretchable display may maintain the resolution of the stretchable display after or before the stretchable display is stretched, and more particularly, may generate the second pixel driving signal to drive the second pixel additionally provided based on whether the stretchable display is displayed, the first pixel driving signal applied to the first driving circuit, and the power signal.

Meanwhile, the technical effects obtained in the inventive concept are not limited to the aforementioned effects, and any other technical effects not mentioned herein will be clearly understood from the following description by those skilled in the art to which the inventive concept pertains.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but illustrative.

What is claimed is:

1. An apparatus for driving a stretchable display comprising:

a first pixel driving signal generating module configured to generate a first pixel driving signal including data to be displayed on a stretchable display;

a first pixel driving circuit configured to receive the first pixel driving signal to drive a first pixel;

a second pixel driving circuit configured to drive a second pixel, wherein the driving of the second pixel is determined depending on whether the stretchable display is stretched; and a second pixel driving signal generating module configured to receive the first pixel driving signal and a power signal and to generate a second pixel driving signal to be applied to the second pixel driving circuit by using one of the first pixel driving signal and the power signal, based on a stretching state signal generated depending on whether the stretchable display is stretched.

2. The apparatus of claim 1, wherein the second pixel driving signal generating module includes:

a second pixel driving signal generating unit to generate the second pixel driving signal, based on whether the stretchable display is stretched, the first pixel driving signal applied to the first pixel driving circuit, and the power signal, such that the second pixel driving signal is applied to the second pixel driving circuit including the second pixel.

3. The apparatus of claim 2, wherein the second pixel driving signal generating module includes:

a first pixel driving signal receiver configured to receive the first pixel driving signal generated from the first pixel driving signal generating unit and applied to the first pixel driving circuit;

a power signal receiver configured to receive the power signal; and a stretching state signal generating unit configured to generate the stretching state signal depending on whether the stretchable display is stretched.

4. The apparatus of claim 3, wherein the stretching state signal generating unit:

generates a first stretching state signal, when the stretchable display is stretched; and generates a second stretching state signal, when the stretchable display is not stretched.

5. The apparatus of claim 4, wherein the second pixel driving signal generating unit:

generates the second pixel driving signal, based on the first pixel driving signal, when receiving the first stretching state signal; and generates the second pixel driving signal based on the power signal, when receiving the second stretching state signal.

6. The apparatus of claim 5, wherein the second pixel driving signal generating unit includes:

a first transistor; and a second transistor.

7. The apparatus of claim 6, wherein the first transistor includes a PMOS transistor, and the second transistor includes an NMOS transistor.

8. The apparatus of claim 7, wherein a source terminal of the first transistor is connected to the first pixel driving signal receiver;

wherein a source terminal of the second transistor is connected to the power signal receiver;

wherein gate terminals of the first transistor and the second transistor are connected to the stretching state signal generating unit; and wherein a drain terminal of the first transistor and a drain terminal of the second transistor are connected to each other.

9. The apparatus of claim 8, wherein the first stretching state signal is a preset fourth voltage, wherein the second stretching state signal is a preset third voltage, and wherein the power signal is 'a preset first voltage.

10. The apparatus of claim 7, wherein the first transistor includes a first PMOS transistor, and wherein the second transistor includes a second PMOS transistor.

11. The apparatus of claim 10, wherein a source terminal and a gate terminal of the first transistor are connected to the first pixel driving signal receiver, wherein a drain terminal of the second transistor is connected to the power signal receiver, wherein a gate terminal of the second transistor is connected to the stretching state signal generating unit, and wherein a drain terminal of the first transistor and a source terminal of the second transistor are connected to each other.

12. The apparatus of claim 11, wherein the first stretching state signal is a preset third voltage, wherein the second stretching state signal is a preset fourth voltage, and wherein the power signal is a preset second voltage.

13. The apparatus of claim 7, wherein the first transistor includes a first NMOS transistor, wherein the second transistor includes a second NMOS transistor.

14. The apparatus of claim 13, wherein a drain terminal of the first transistor is connected to the first pixel driving signal receiver, wherein a source terminal of the second transistor is connected to the power signal receiver, wherein a gate terminal of the second transistor is connected to the stretching state signal generating unit, and wherein the source terminal of the first transistor, the gate terminal of the first transistor, and a drain terminal of the second transistor are connected to each other.

15. The apparatus of claim 14, wherein the first stretching state signal is a preset fourth voltage, wherein the second stretching state signal is a preset third voltage, and wherein the power signal is a preset first voltage.

* * * * *